US011247221B2

(12) United States Patent
Lee

(10) Patent No.: US 11,247,221 B2
(45) Date of Patent: Feb. 15, 2022

(54) TRIGGER SPRAYER

(71) Applicant: RIEKE CORPORATION, Auburn, IN (US)

(72) Inventor: Yen Kean Lee, Rohnert Park, CA (US)

(73) Assignee: RIEKE LLC, Auburn, IN (US)

( * ) Notice: Subject to any disclaimer, the term of this patent is extended or adjusted under 35 U.S.C. 154(b) by 435 days.

(21) Appl. No.: 16/332,416

(22) PCT Filed: Sep. 12, 2017

(86) PCT No.: PCT/US2017/051098
§ 371 (c)(1),
(2) Date: Mar. 12, 2019

(87) PCT Pub. No.: WO2018/049373
PCT Pub. Date: Mar. 15, 2018

(65) Prior Publication Data

US 2021/0283631 A1 Sep. 16, 2021

Related U.S. Application Data

(60) Provisional application No. 62/393,161, filed on Sep. 12, 2016.

(51) Int. Cl.
*B05B 11/00* (2006.01)
*B05B 1/30* (2006.01)

(52) U.S. Cl.
CPC ..... *B05B 11/3011* (2013.01); *B05B 1/30* (2013.01); *B05B 11/0029* (2013.01)

(58) Field of Classification Search
CPC ..... B05B 11/0027; B05B 11/0029; B05B 11/0032; B05B 11/3057; B05B 11/3059; B05B 1/30; B05B 11/3011; B65D 83/22
See application file for complete search history.

(56) References Cited

U.S. PATENT DOCUMENTS 4,204,614 A * 5/1980 Reeve ..... B05B 1/12 215/209
4,516,695 A * 5/1985 Garneau ..... B05B 11/0029 222/153.14

(Continued)

FOREIGN PATENT DOCUMENTS

CA 2046990 1/1992
EP 2020264 2/2009

OTHER PUBLICATIONS

Patent Cooperation Treaty (PCT), International Search Report and Written Opinion for Application PCT/US2017/051098 filed Sep. 12, 2017, dated Dec. 4, 2017, International Searching Authority, US.

(Continued)

*Primary Examiner* — Ryan A Reis
(74) *Attorney, Agent, or Firm* — McDonald Hopkins LLC

(57) ABSTRACT

A trigger sprayer for connection to a container or liquid product which is to be dispensed is disclosed. The trigger sprayer includes a trigger body with a first engagement member and a nozzle with a second engagement member. The first engagement member is constructed and arranged to receive the second engagement member. The second engagement member is moveable relative to the first engagement member between a first position and a second position. Movement of the second engagement member relative to the first engagement member between the first and second positions encounters a region of increased resistance.

10 Claims, 10 Drawing Sheets

(56) References Cited

U.S. PATENT DOCUMENTS

| | | | | |
|---|---|---|---|---|
| 5,040,702 | A * | 8/1991 | Knickerbocker | B05B 11/0029 222/153.07 |
| 5,526,985 | A * | 6/1996 | Martin | B05B 1/12 239/478 |
| 6,126,090 | A * | 10/2000 | Wadsworth | B05B 1/12 239/333 |
| 6,227,411 | B1 | 5/2001 | Good | |
| 6,267,271 | B1 | 7/2001 | Tsuchida | |
| 7,036,689 | B1 * | 5/2006 | Laffey | B05B 11/0029 215/216 |
| 2005/0133627 | A1 * | 6/2005 | Hornsby | B05B 1/30 239/451 |

OTHER PUBLICATIONS

European Patent Office, Extended European Search Report for EU Pat. Application No. 17849756.6, dated Apr. 17, 2020.

* cited by examiner

TRIGGER SPRAYER

RELATED APPLICATIONS

This application claims priority to and incorporates by reference U.S. Provisional Patent Application Ser. No. 62/393,161 filed on Sep. 12, 2016.

TECHNICAL FIELD

The present invention is directed to a fluid packaging system and, more particularly, a trigger sprayer container having a selectively activated trigger in combination with a movable or rotatable nozzle selective positioned between ON (i.e., open or usable) and OFF (i.e., closed or nonusable) positions.

BACKGROUND

Bottles and other containers having pump-action sprayers are generally known. These mechanisms typically include manually activated levers that draw and fluid carried in the main body and expel that fluid out through a spray nozzle. These nozzles may include open and closed positions to ensure accidental activation of the lever does not result in unwanted spray/discharging of the fluid.

These products generally reach the end-use consumer by means of a retail supply chain or by means of an e-commerce supply chain. Each of these supply chains entails different levels of risk with respect to the need for protective packaging as well as the likelihood of being dropped, subjected to vibration or other impact or simply the results of rough handling.

Trigger sprayer products traveling to the end-use consumer by way of the e-commerce supply chain have higher risks owing to their likelihood of being shipped in small, soft-sided packages and/or as individual containers (rather than in bulk with a large number of identical containers provided in a solid-sided crate or heavily protected skid). Thus, e-commerce products are more likely to have the nozzle of the trigger sprayer moved, jarred, skewed or twisted while in transit, as well as the nozzle being moved closer to the ON position where there would be an open path for product leakage.

Some trigger sprayers have a generally cylindrical form of mating or interfit between the nozzle and the trigger body. As such, it is fairly easy for the end-use customer to turn or rotate the nozzle relative to the trigger body in order to move the nozzle from either an ON position to an OFF position or from an OFF position to an ON position. This ease of rotation of the nozzle for the end-use consumer is facilitated by the generally cylindrical mating structures of the nozzle and of the trigger body. This generally cylindrical mating relationship or engagement between the nozzle and the trigger body is part of what creates the risk of the nozzle being inadvertently moved from an OFF position to an ON position, or at least closer to that ON position, during e-commerce transit.

A design, particularly for use in e-commerce transit, that provides greater resistance to rotation of the nozzle relative to the trigger body would be welcomed. Additionally, a container system that provides positive indication of being in a desired setting or movement between the settings is needed, such be way of an audible and/or tactile indication in the form of a "click" type noise/feel.

SUMMARY

Specific reference is made to the appended claims, drawings, and description below, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

Various aspects of the invention are described. Notwithstanding these descriptions directed to particular combinations of features, it will be understood that portions of aspects from one described embodiment may still be combined with those from other aspects. With this in mind, one aspect of the invention may include any combination of the following:

- a body including a flow passage for the fluid, the flow passage terminating at a proximal end of the body proximate to at least one first engagement member;
- a nozzle connected to the proximal end and including a second engagement member;
- wherein the first and second engagement members cooperate to allow movement of the nozzle relative to the body between a first position a and second position, with a region of increased resistance provided by a shape of the first engagement member relative to a shape of the second engagement member;
- wherein said first engagement member is a post;
- wherein said second engagement member is a sleeve;
- wherein said post has an outer surface which includes a plurality of flats;
- wherein said sleeve has an inner surface which includes a plurality of flats;
- wherein alignment of one of said flats of said post with one of said flats of said sleeve denotes one of said first and second positions;
- wherein the shape of the first engagement member includes a rounded outer surface with a plurality of flat portions formed thereon and wherein the shape of the second engagement member includes a rounded inner surface with a plurality of flat portions formed therein;
- wherein the second engagement member is received within the first engagement member;
- wherein said first position is either an ON condition or an OFF condition for said trigger sprayer;
- wherein said first engagement member is a post which has an outer surface including a plurality of flats;
- wherein said second engagement member is a sleeve having an inner surface which includes a plurality of flats;
- wherein alignment of one of said flats of said post with one of said flats of said sleeve denotes one of said first and second positions;
- wherein a shroud is fitted over the body; and
- wherein the body includes at least one reinforcing member formed at a high stress point within the body.

BRIEF DESCRIPTION OF THE DRAWINGS

Operation of the invention may be better understood by reference to the detailed description taken in connection with the following illustrations. These appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

FIG. 13A is a three dimensional illustration of a shroud which fits over the body to improve structural integrity and, optionally, provide additional ornamentation and styling, while

DESCRIPTION OF THE SELECTED EMBODIMENTS

Figure 1:
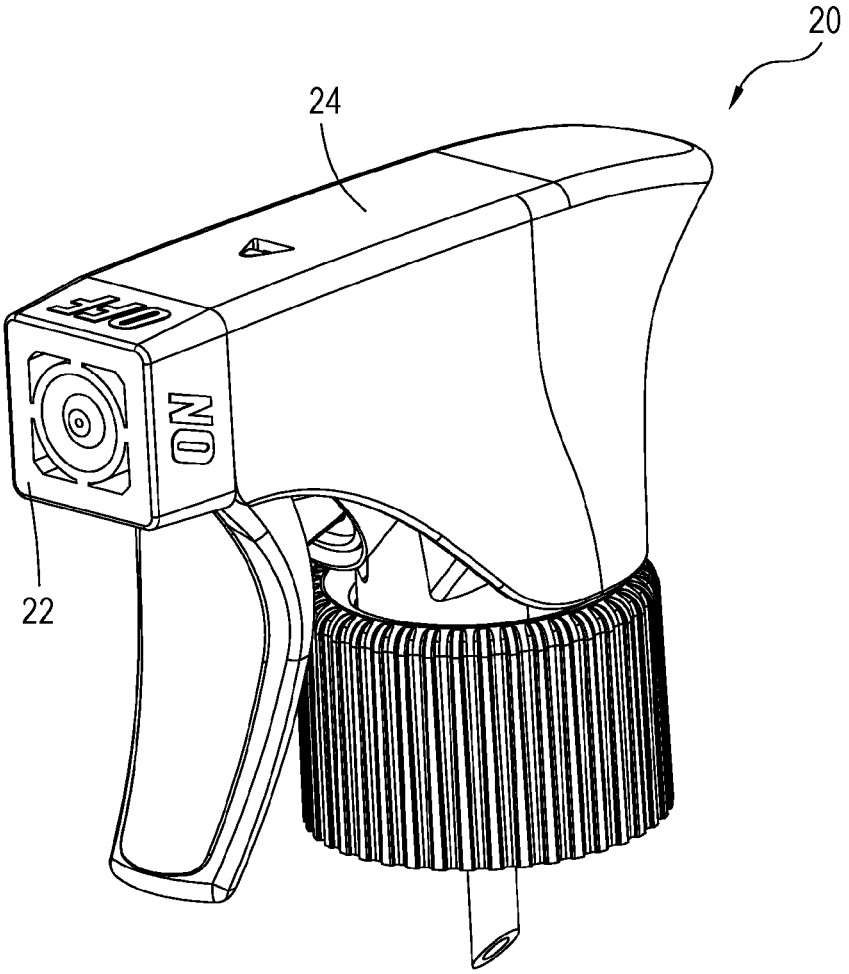
FIG. 1 is a perspective view of a trigger sprayer according to an exemplary embodiment of the present invention.
Figure 2:
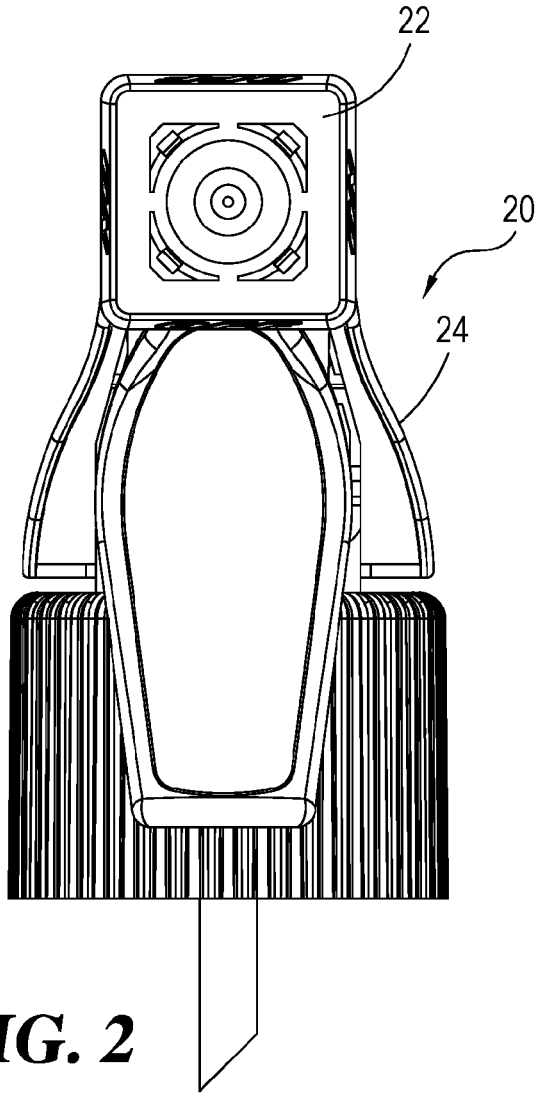
FIG. 2 is a front elevational view of the FIG. 1 trigger sprayer.
Figure 3:
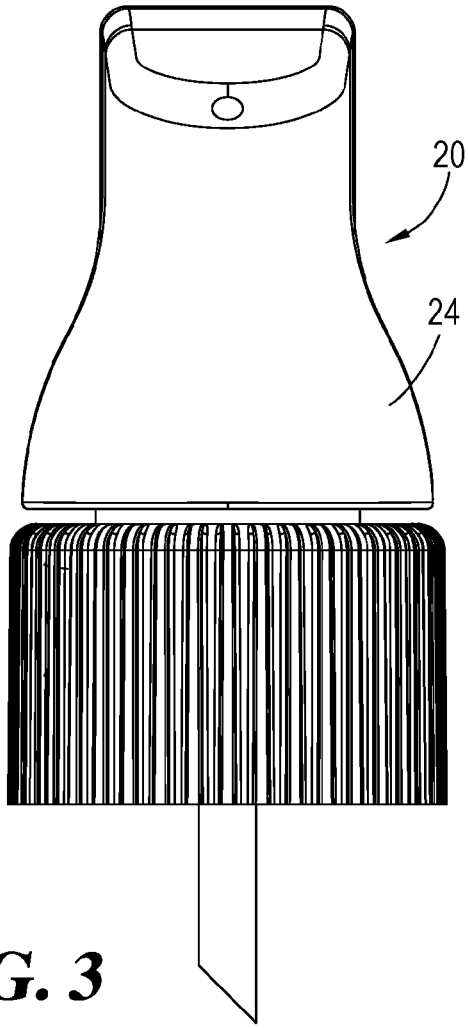
FIG. 3 is a rear elevational view of the FIG. 1 trigger sprayer.
Figure 4:
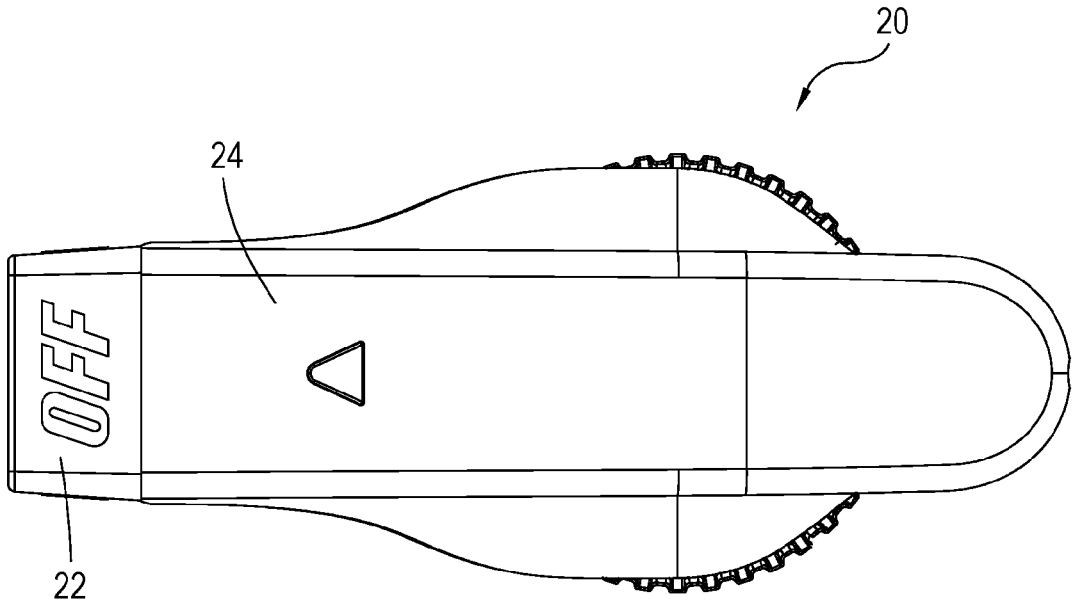
FIG. 4 is a top plan view of the FIG. 1 trigger sprayer.
Figure 5:
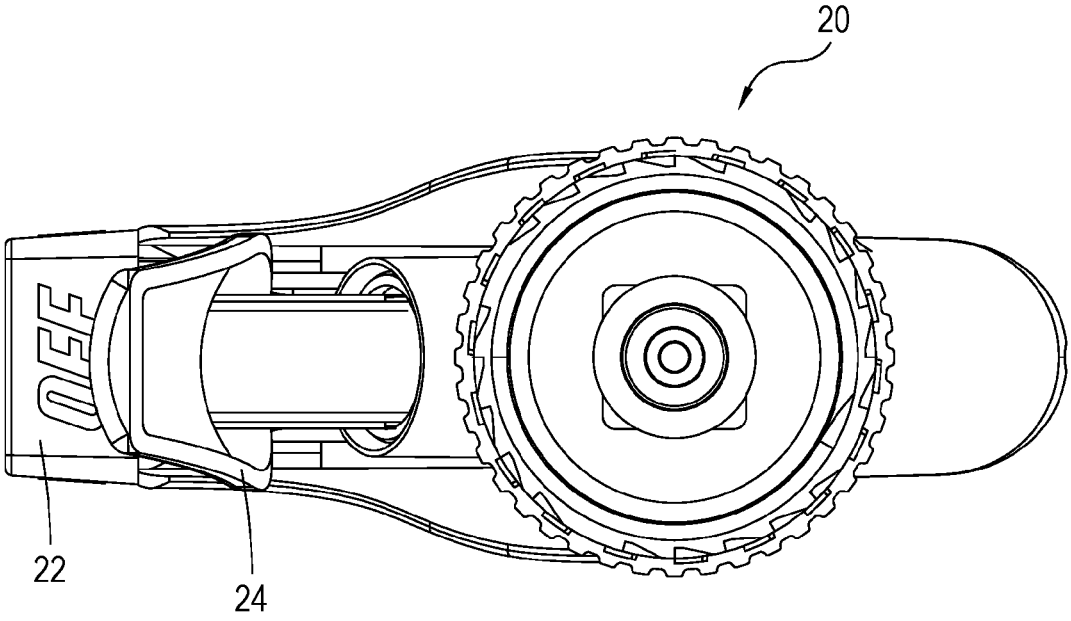
FIG. 5 is a bottom plan view of the FIG. 1 trigger sprayer.

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Exemplary embodiments of the present invention are directed to a construction option for increasing the resistance to rotation of the nozzle relative to the trigger body of a trigger sprayer mechanism that may be attached to containers and other objects for dispensing fluid products. Generally speaking, flatted surfaces of an otherwise generally round cylindrical form in those surfaces mate or engage as the nozzle is assembled onto the trigger body. With four equally-spaced flats on the mating sleeve of the nozzle and with four matching, equally-spaced flats on the mating post of the trigger body, there is a definite and positive indication of proper positioning of the nozzle relative to the trigger body, either in the ON position or in the OFF position. The use of these equally-spaced flats on the outer surface of the mating post and on the inner surface of the mating sleeve could be accomplished with a different number of flats depending on the number of position options for the nozzle. Additionally, the selected structures could be different as the key is to increase the resistance to rotation. However, the use of four equally-spaced flats is considered the preferred embodiment and the preferred option as the nozzle would typically have four surfaces with positions marked.

The specific construction selected for increasing the resistance to rotation is based on providing a surface of increased size as part of the inner post which the outer sleeve must ride up and over in order to move from one position to the next position. When it is desired to rotate the nozzle from one position to another, the engaging sleeve of the nozzle must slide over a surface of the mating post which is radially larger than the mating flat surface. This radially larger surface can be thought of as a raised surface which the nozzle must slide over as it is rotated. This requires the nozzle to flex and distort slightly and creates greater resistance to the turning or rotation than what would otherwise exist without the mating flats on these two engagement surfaces. When the raised surfaces are cleared by continued rotation of the nozzle, the nozzle snaps back as the flexing and distortion are relieved such that the two cooperating sets of four equally-spaced flats are once again aligned with each other. This "snap back" of the rotating nozzle may provide both an audible "click" to the user as well as tactile feedback to the user who is rotating the nozzle.

This increased resistance to rotation of the nozzle relative to the trigger body is not at a level which is considered unacceptable to the end-use customer. While there is greater resistance to rotation, the strength required to rotate the nozzle is well within the capability of all expected end-use customers. However, the increased resistance to rotation of the nozzle relative to the trigger body is at a level which makes it less likely for the nozzle to be inadvertently moved to the ON position during transit, primarily during e-commerce transit where the risks of inadvertent movement of the nozzle relative to the trigger body are believed to be greater.

Referring to FIGS. 1-6 there is illustrated a trigger sprayer 20 which is constructed and arranged to dispense a fluid product in the form of a spray. While there may be a technical different between a spray and a mist in terms of droplet size, any difference or distinction in this regard is not germane to this disclosure. Accordingly, the term "spray" is used with the expressed intention of including within its scope all droplet sizes which might logically emanate from a trigger sprayer, such as trigger sprayer 20.

Figure 7:
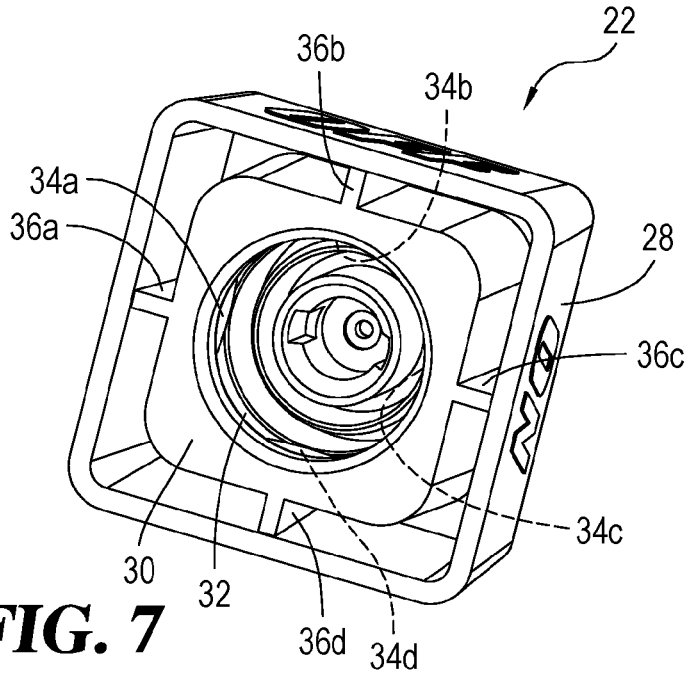
FIG. 7 is a perspective view of the nozzle which comprises one part of the FIG. 1 trigger sprayer.
Figure 8:
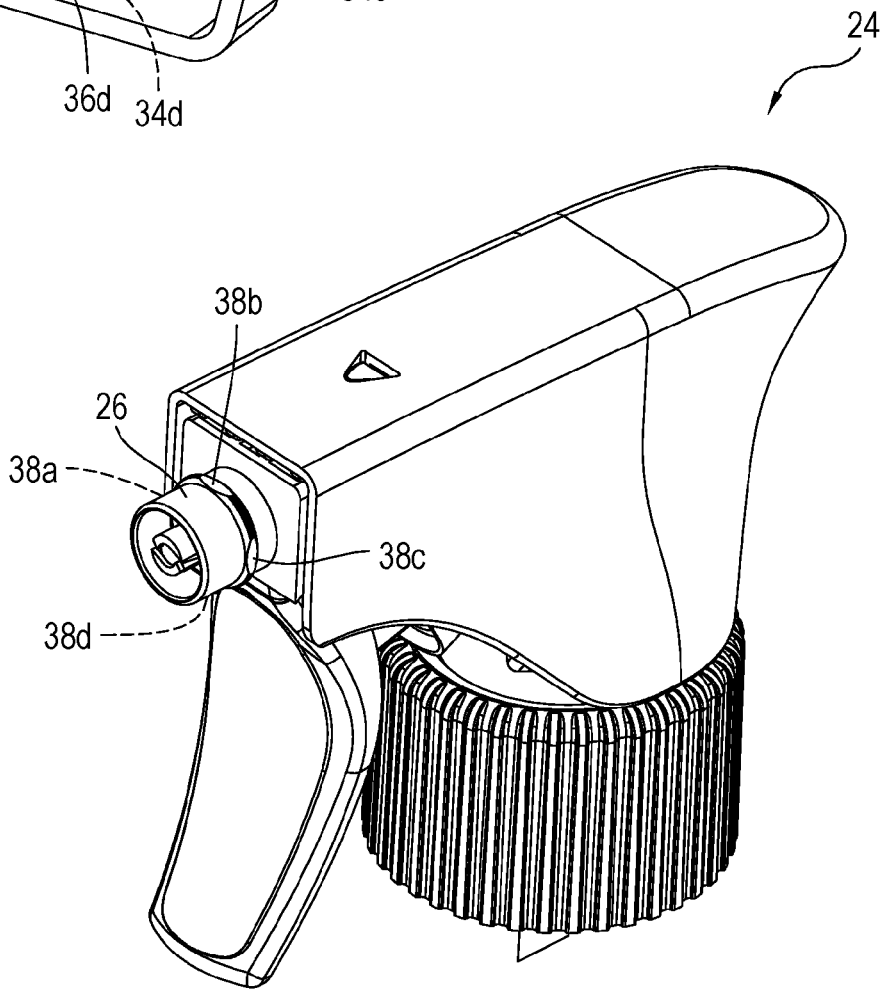
FIG. 8 is a perspective view of the trigger body which comprises one part of the FIG. 1 trigger sprayer.

Trigger sprayer 20 includes a nozzle 22 (see FIG. 7) and a trigger body 24 (see FIG. 8). It is the engagement between nozzle 22 and trigger body 24 which is the focus of the exemplary embodiment of the present invention. This engagement focuses on how nozzle 22 fits onto post 26 as part of the assembly of nozzle 22 onto trigger body 24. The manner of engagement or assembly interfit typically found between nozzles and posts of prior art trigger sprayers includes a generally cylindrical sleeve (of the nozzle) with a sliding fit onto a generally cylindrical post (of the trigger body). The exemplary embodiment of the present invention, as disclosed herein, introduces a change to these generally cylindrical forms by adding flatted, spaced-apart surfaces on each of the mating or engaging forms.

Figure 6:
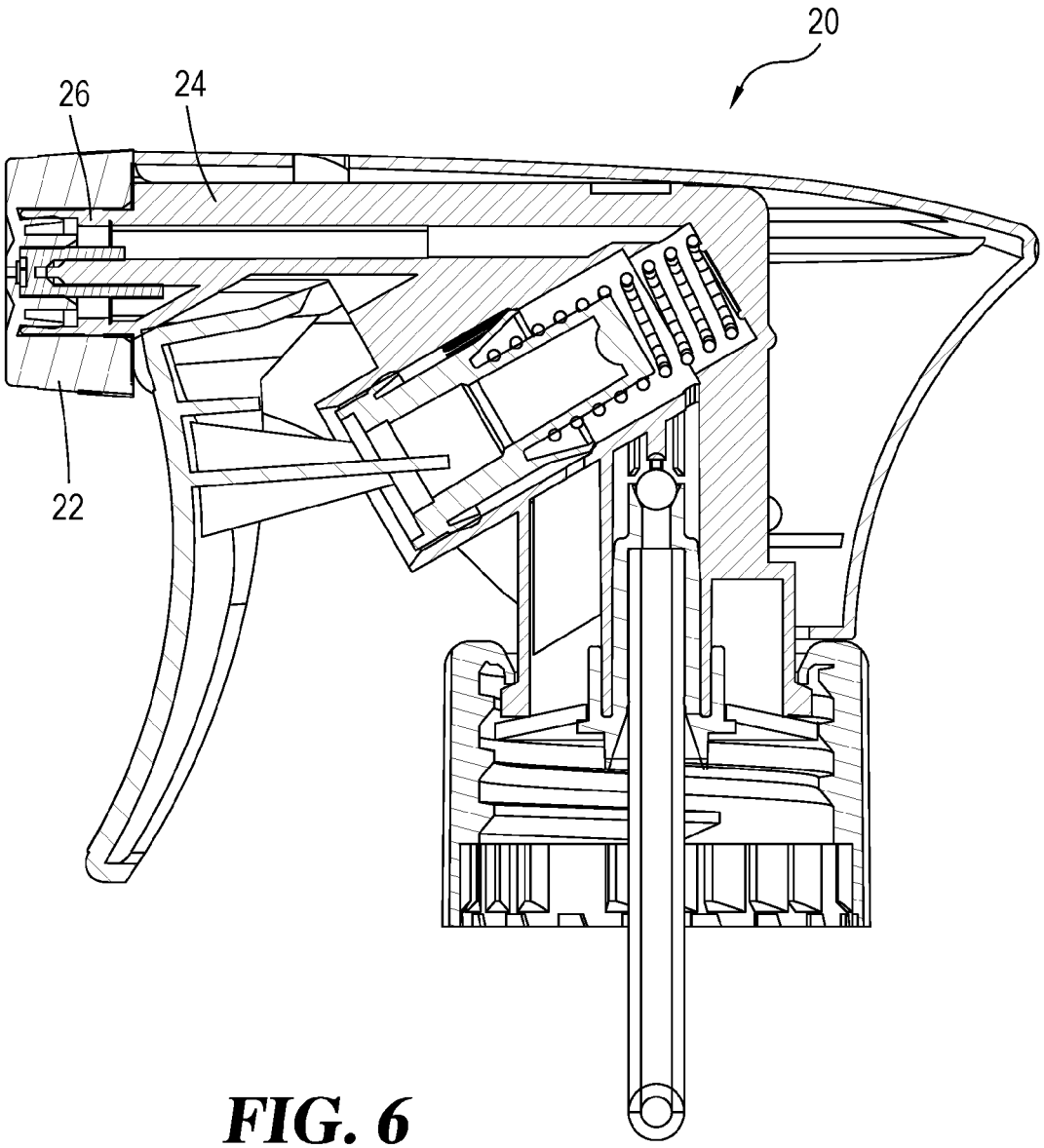
FIG. 6 is a right side elevational view, in full section, of the FIG. 1 trigger sprayer.

The trigger sprayer 20, see FIG. 6, is assumed to be of a conventional construction except for the specific features which are disclosed herein as part of the exemplary embodiment. The point to be made is that the specific features which are disclosed herein in order to increase resistance to rotation of the nozzle 22 relative to the post 26, as explained in greater detail below, are applicable to virtually any style of trigger sprayer which has the generally cylindrical forms of engagement between the nozzle and the post of the trigger body. Further structures ensure the sprayer 20 maintains sufficient rigidity and structural integrity to avoid or mitigate against other conditions in which fluid might otherwise leak or escape from the sprayer 20.

The body 24 of the sprayer defines at least one fluid passage through its inner portion to allow fluid to be drawn into the body and then expelled through the nozzle. The body 24 also accommodates pumps or other structures to facilitate in this regard in a manner known in this field.

With reference to FIG. 7, nozzle 22 has a generally square outer body 28 with an inner block 30 defining a centered engagement sleeve 32 which has a generally cylindrical form, except for its four, equally-spaced flats 34*a*-34*d* formed, molded or machined into or as a part of the otherwise generally cylindrical inside diameter surface. Inner block 30 and outer body 28 are spaced apart and integrally joined by four, equally-spaced webs 36*a*-36*d*. The geometry of this inner diameter sleeve 32 formed in the center of inner block 30, has the appearance of a square, but with radius corners which correspond to a circle overlaying the square.

Figure 9:
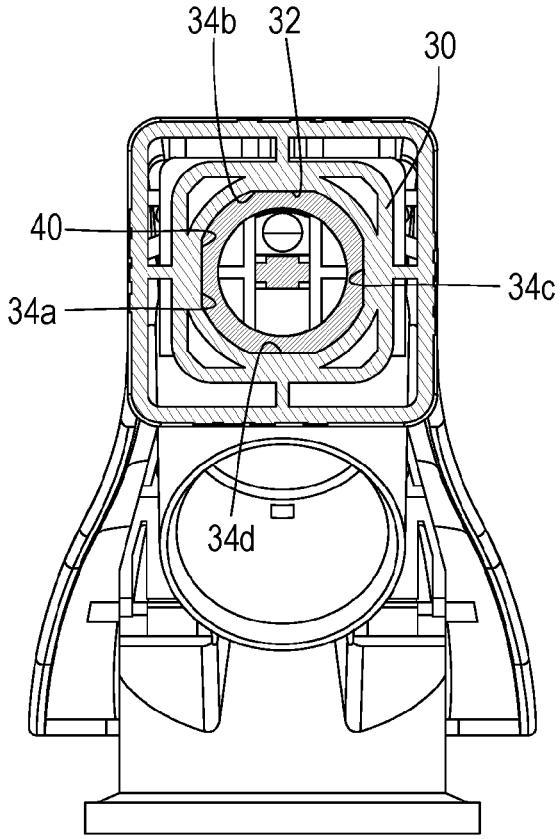
FIG. 9 is a front elevational view, in full section, of the nozzle of FIG. 7 showing the shaping of the inner sleeve.
Figure 10:
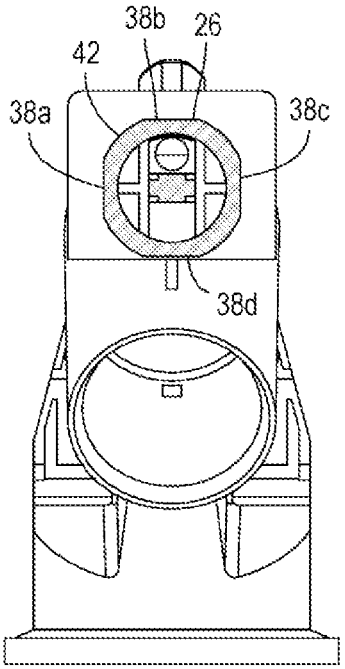
FIG. 10 is a front elevational view, in full section, of the trigger body post showing the outer surface shaping for engagement with the nozzle.

With reference to FIG. 8, the post 26 of trigger body 24 is illustrated showing two of the four equally-spaced flats 38*a*-38*d*. Flats 38*a*-38*d* are sized and arranged to produce an outer surface geometry which is compatible with the inner surface geometry of inner block 30 (see FIG. 11). These compatible surface geometries, as shown in FIGS. 9 and 10, enable the mating engagement or interfit which has been described and which is illustrated in FIG. 11.

Figure 9A:
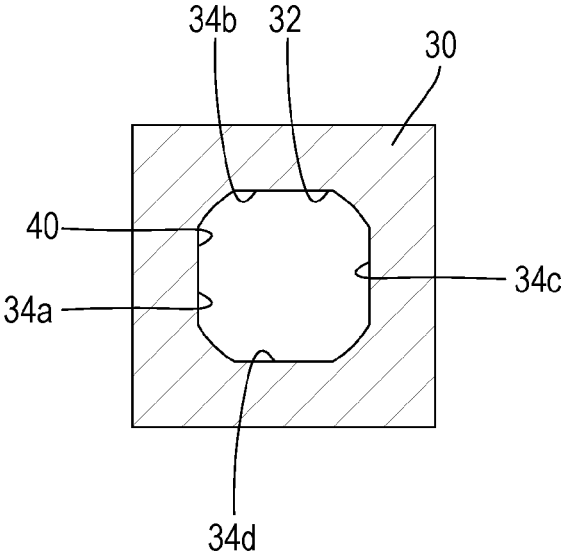
FIG. 9A is a diagrammatic illustration of the flats on the inner sleeve.
Figure 9B:
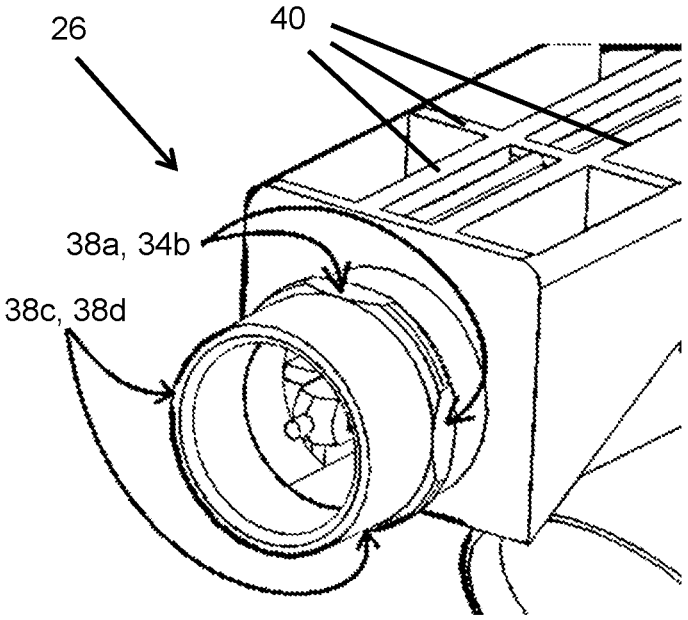
FIG. 9B is a three dimensional illustration of the body and post to highlight the flats shown in FIG. 9A.
Figure 9C:
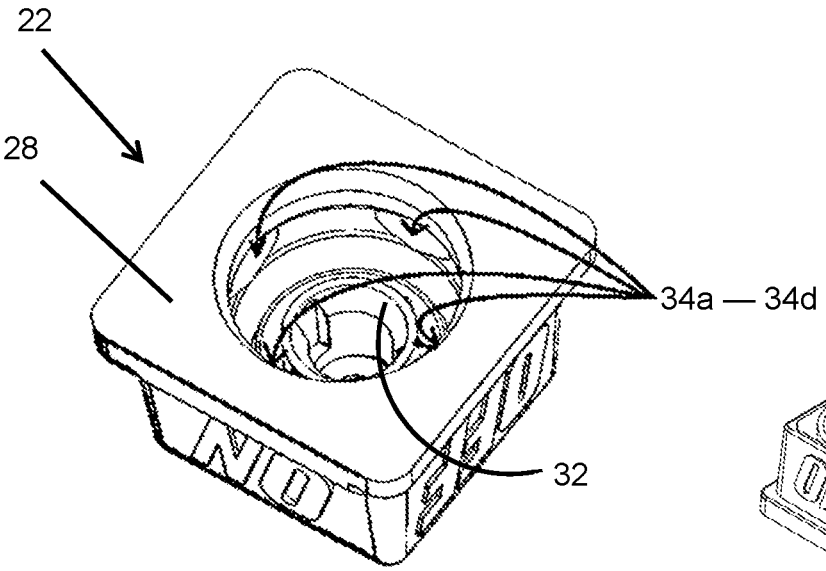
FIGS. 9C and 9D are three dimensional illustrations of the nozzle, showing the inner and outer facings thereof, with FIG. 9C particularly depicting the flats which engages those corresponding with the body as shown in FIG. 9B.
Figure 9D:
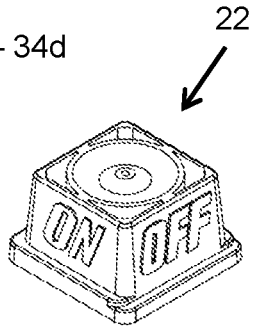
Figure 10A:
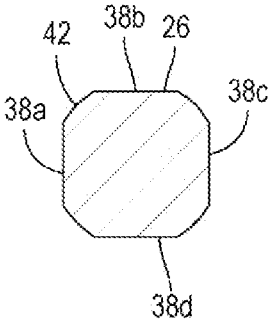
FIG. 10A is a diagrammatic illustration of the flats on the trigger body post.

Diagrammatic illustrations of the flats on the mating surfaces are provided by FIGS. 9A and 10A. Further, in FIG. 9B, a three dimensional illustration shows the orientation of the flats 38*a*-38*d* as they are distributed around a portion where the post 26 connects to the body 24. Correspondingly, FIGS. 9C and 9D show isolated views of only the nozzle 22.

With reference to FIG. 9C, the square outer body 28 defines the opening in which the inner diameter sleeve 32 and flats 34*a*-34*d* are formed. The flats 34*a*-34*d* are distributed in a similar, corresponding configuration to flats 38*a*-38*d* along the post, while sleeve 32 may form a concentric fit with the distal end of the post so as to ensure the nozzle 22 may rotate along a defined path when twisted relative to the body 24.

Figure 11:
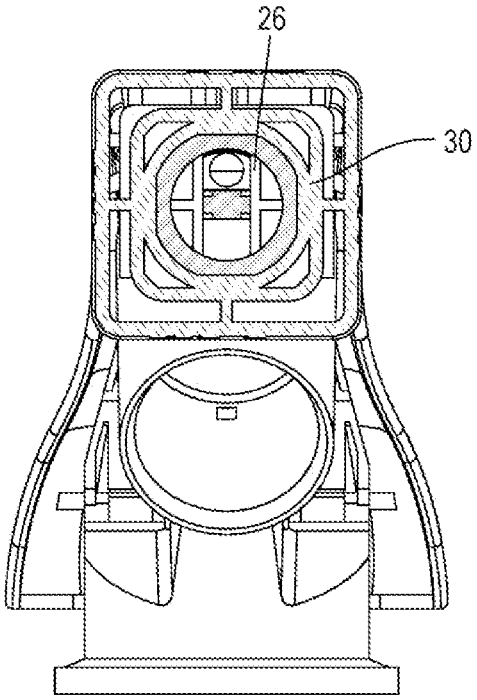
FIG. 11 is a front elevational assembly illustration, in full section, of the FIG. 9 nozzle as assembled onto the FIG. 10 trigger body post.

The assembly is shown in its final form in FIG. 11. When the nozzle is rotated in a clockwise direction based on the FIG. 11 assembly view, shown in full section, from either an ON or OFF position to the other position (OFF or ON), one side 40 must ride up over one radiused corner 42. This "riding up" movement actually occurs at all four locations in a generally concurrent fashion. The shape of inner block 30 must flex or distort a little due to the slightly larger radial dimension of corner 42 compared to that of side 40. With continued rotation the flats 34*a*-34*d* will line up with flats 38*a*-38*d*. The denotes the point at which the nozzle reaches the desired position relative to the trigger body, either an ON position or an OFF position. The flexed or distorted shape of inner block 30 will return to its normal, undistorted shape when the two sets of flats are once again aligned. At the point of reestablishing alignment of the two sets of flats, there may be either an audible "click" to the user or tactile feedback to the user or both. With this increased resistance to rotation of the nozzle relative to the trigger body, there is less likelihood of the nozzle moving either closer to or to the ON position during e-commerce transit.

Figure 12:
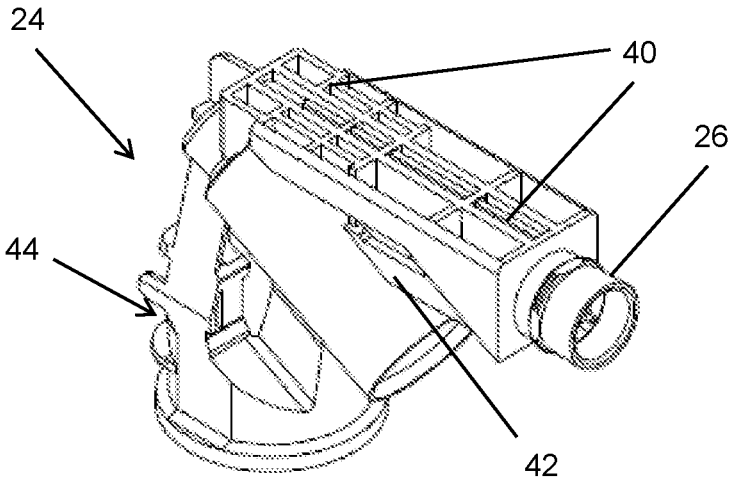
FIG. 12 is a sectional three dimensional illustration of the body to highlight reinforcement ribs along the top, bottom, and trigger portions thereof.

Additional features are provided to ensure the sprayer 20 has sufficient structural strength and rigidity to withstand the forces applied during shipment, particularly without the need for a separate, hard-sided box, package, or crate. With reference to FIGS. 9B and 12, a series of reinforcing members 40, 42, 44 may be formed in, along, or proximate surfaces of the body 26 at a series of high stress or flexing points. Unwanted movement, cracks or other breakage, or even temporary displacement/separation of the component(s) at these points could lead to rotation of the nozzle 22 and/or formation of temporary gaps between the components of the sprayer 20 that results in leakage of fluid).

Ribs 40 may be formed in a regular pattern along the top facing surface of the body 24, with a more densely packed web closer to where the body 26 forms an angle or L-shape. The individual ribs 40 may be of the identical or varying thickness, with transverse and lateral individual sections forming a series of right angles.

Rib or ribs 42 may also be provided where the body 24 provides structures to accommodate the actuator, such as a pump-action lever or trigger (not shown), which physically draws fluid from into the sprayer 20 and expels it as spray or mist out of the post 26/nozzle 22 combination.

Lastly, one or more ribs or wall sections 44 having a vertical orientation along the body 24 on its distal end (i.e., back end opposite where the post/nozzle are provided). Wall 44 has increasing thickness and a larger radius at is lowermost end, where it establishes connection with the closure 60 described below.

Figure 13A:
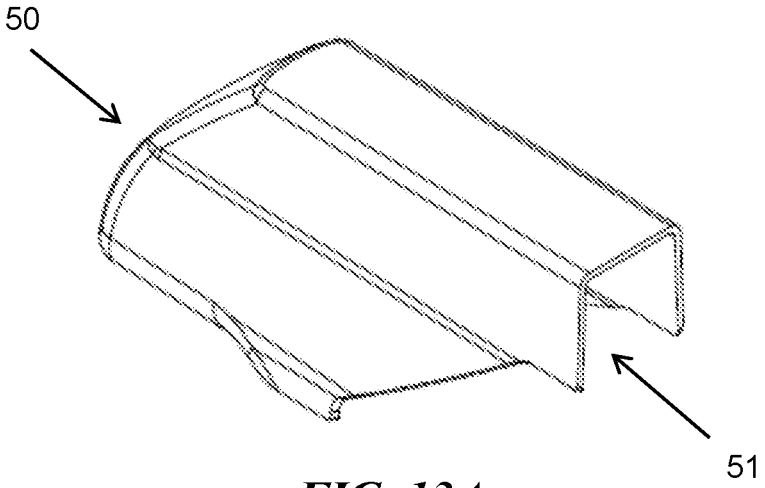
Figure 13B:
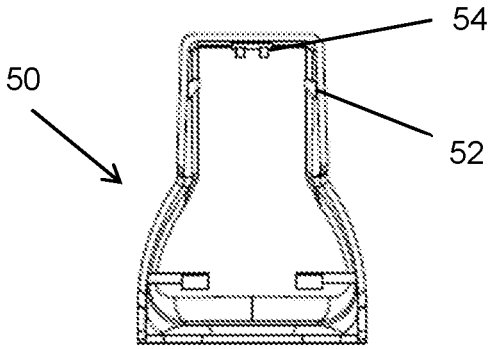
FIG. 13B is a front plan view of the shroud of FIG. 13A, oriented where an opening is formed to accommodate the post/nozzle features, so as to highlight where the side snap keys and support keys may be positioned along an inner facing surface thereof for engagement to the body shown, for example, in FIG. 12.

In some embodiments, the body 24 may be connected to and covered by a protective and decorative shroud 50, as shown in isolation in FIGS. 13A and 13B (other drawings, including FIG. 8, show some versions of the shroud as it would be attached to the body 24). The shroud 50 is formed to have a shell-like appearance, with the top surface of the body 24 received along its lower opening 51. The shroud allows for varying contours and/or decorative elements to be provided, without needing to substantially alter the functional components concealed underneath it.

A plurality of side snap keys 52 are provided along the inner surface of the shroud 50 where it mates with the body 24, as seen in FIG. 13B. Additional support keys 54 may also be formed thereon. Keys 52, 54 may be snap-fitting posts, tabs, or other structures that are received by or mate to corresponding portions of the body. For example, keys 54 may fit within gaps provided by the web of ribs 40, while keys 52 may engage the closure 60 and/or the container itself (not shown). Thus, the shroud 50 is preferably formed from a semi-resilient material that can withstand flexing (as is expected between the flats 34*a*-34*d* and 38*a*-38*d*, as described above).

Figure 14:
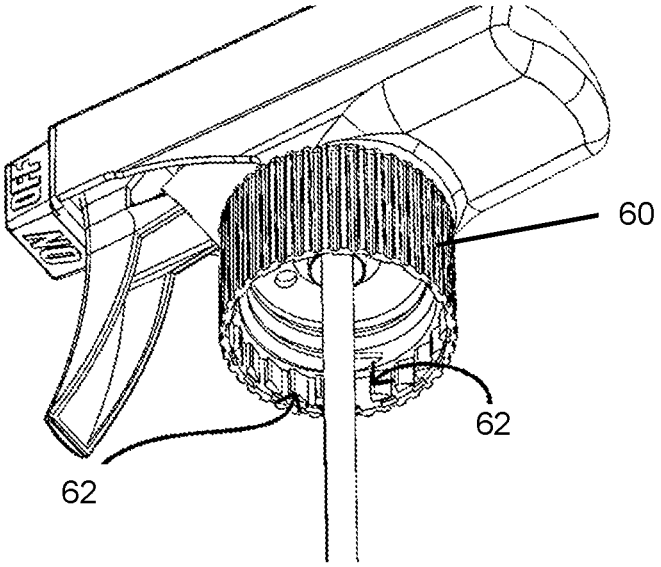
FIG. 14 is a three dimensional illustration of a closure ring that may be provided along the bottom portion of the body to enable selective engagement to a container or other fluid containing body adapted to receive and attach to the closure ring (e.g., male-female fitting, screw fitting, etc.).

Further, as seen in FIG. 14, a closure 60 facilitates connection of the body 24 to a container or other object. It will be understood that container/object should be provided with a cooperating opening to accommodate the functioning of sprayer 20. The closure 60 may be formed as a circular ring piece having a textured or knurled exterior circumference. The inner annulus is tapped or threaded to engage corresponding structure on the container/object. In addition, a series of ratchet closures 62 are formed to address closure backoff leakage (again, with corresponding structure formed on the container/object). These ratchets 62 are sized to have reduced interference that still enables a user to displace the ratchets with the application of sufficient flexing force on the ring 60, thereby allowing the ring to be rotated when the ratchets disengage. In turn, rotation of the ring allows for removal of the sprayer 20 from the container/object for the purpose of refilling liquids.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

I claim:

1. A trigger sprayer selectively connectable to a fluid carrying container comprising:

a body including a flow passage for the fluid, the flow passage terminating at a proximal end of the body proximate to at least one post;

a nozzle connected to the proximal end and including a sleeve;

wherein the post and the sleeve are: (i) configured to engage one another along a common surface and (ii) cooperate to allow rotation of the nozzle relative to the body between a first position and a second position, with a region of increased resistance provided by a cross-sectional shape of the post relative to a cross-sectional shape of the sleeve; and wherein, along the common surface, the cross sectional shape of the post consists of a circular outer surface with equally spaced flat portions conforming to a square overlaid therein and the cross-sectional shape of the sleeve consists of a circular inner surface with equally spaced flat portions conforming to a square overlaid therein formed therein.

2. The trigger sprayer of claim 1 wherein rotation of said flats of said post with one of said flats of said sleeve denotes one of said first and second positions.

3. The trigger sprayer of claim 1 wherein the sleeve is concentrically fitted around a distal end of the post.

4. The trigger sprayer of claim 1 wherein said first position is either an ON condition or an OFF condition for said trigger sprayer.

5. The trigger sprayer of claim 1 wherein a shroud is fitted over the body.

6. The trigger sprayer of claim 5 wherein the body includes at least one reinforcing member formed at a high stress point within the body.

7. The trigger sprayer of claim 1 wherein a shell-shaped shroud having at least one snap-fitting formed on an inner surface is coupled to at least one corresponding snap-fitting formed on an outer surface of the body.

8. The trigger sprayer of claim 7 wherein the inner surface includes a web of ribs.

9. The trigger sprayer of claim 8 wherein the shroud is formed from a semi-resilient material.

10. The trigger sprayer of claim 2 wherein each alignment of the post and the sleeve into the first position and the second position produces an audile click and/or tactile feedback.

* * * * *